US008267341B2

(12) United States Patent
Pallmann

(10) Patent No.: US 8,267,341 B2
(45) Date of Patent: Sep. 18, 2012

(54) DEVICE FOR PROCESSING FEEDSTOCK

(75) Inventor: Hartmut Pallmann, Zwelbruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 194 days.

(21) Appl. No.: 12/569,544

(22) Filed: Sep. 29, 2009

(65) Prior Publication Data

US 2010/0090044 A1 Apr. 15, 2010

(30) Foreign Application Priority Data

Sep. 29, 2008 (DE) ..... 10 2008 049 339

(51) Int. Cl.
*B02C 23/00* (2006.01)

(52) U.S. Cl. ..... 241/188.1; 241/285.1

(58) Field of Classification Search ..... 241/188.1, 241/285.1, 285.2
See application file for complete search history.

(56) References Cited

U.S. PATENT DOCUMENTS 3,881,663 A * 5/1975 Brown ..... 241/225
4,102,504 A * 7/1978 Mushrush et al. ..... 241/185.5
4,635,862 A * 1/1987 West et al. ..... 241/51
5,236,135 A * 8/1993 Wilson et al. ..... 241/21
5,590,840 A * 1/1997 Adams et al. ..... 241/99
5,746,377 A * 5/1998 Gehrig ..... 241/73
5,816,510 A * 10/1998 Earle et al. ..... 241/46.01
2009/0206186 A1* 8/2009 Morrison et al. ..... 241/24.16

FOREIGN PATENT DOCUMENTS

DE 23 53 907 5/1975
EP 0 226 900 A2 7/1987

* cited by examiner

*Primary Examiner* — Faye Francis
(74) *Attorney, Agent, or Firm* — Muncy, Geissler, Olds & Lowe, PLLC

(57) ABSTRACT

A device for processing feedstock, includes a housing surrounding a processing chamber in which a rotational rotor having processing tools and mounted on a drive shaft is disposed around an axis. The feedstock is fed to the processing chamber via a material inlet and removed from the device via a material outlet. To facilitate assembly and disassembly of the device and to retool, maintain and repair or clean the device, it is provided according to the invention that the housing includes a first end wall, a material element in the shape of a hollow cylinder or hollow truncated cone, and a second end wall which are detachably connected to each other to form the processing chamber. The connection can be made by axially acting clamps, which clamp the first end wall against the second end wall by clamping the casing element.

21 Claims, 4 Drawing Sheets

DEVICE FOR PROCESSING FEEDSTOCK

This nonprovisional application claims priority under 35 U.S.C. §119(a) to German Patent Application No. DE 10 2008 049 339.2, which was filed in Germany on Sep. 29, 2008, and which is herein incorporated by reference.

BACKGROUND OF THE INVENTION

1. Field of the Invention

The invention relates to a device for processing feedstock.

2. Description of the Background Art

Devices of this type belong to the field of mechanical process engineering, the goal of which is to process and transform source materials into a predetermined end product or intermediate product for further process steps. Possible types of processing and transformation are the different methods of mechanical crushing as well as agglomeration, mixing, separation, coating, drying, compacting and the like. The feedstock may vary in nature and largely involves substances from organic and anorganic chemistry, including dyes and pigments, the food and plastics industries as well as mineral substances. The range of applications for devices according to the definition of the species is correspondingly broad, these applications being adapted to the special characteristics of the feedstock, the desired end product and the type of processing through suitable selection of the processing tools and by maintaining preset process parameters.

To minimize investment in new machinery and machine components, it is desirable from the perspective of the operator of such devices to be able to perform as many types of processing as possible using a single device, in order to adapt to different feedstock and objectives. However, this requires the ability to retool a device, if necessary by exchanging the machine components characteristic for processing, between one application and a subsequent application, which should be done as easily and quickly as possible in the interest of economical operation.

Another aspect, which has to do with the ability to easily disassemble devices according to the definition of the species, lies in cleaning the device. In the chemical and pharmaceutical industries, in particular, great care must be taken when changing feedstock to avoid mixing the material previously processed with the material to be processed subsequently, which would compromise the material purity of the end or intermediate product. A similar consideration applies to the food industry, where a device according to the definition of the species must be completely and thoroughly cleaned after a standstill or change in feedstock for reasons of hygiene. It is therefore important to easily disassemble and reassemble devices according to the definition of the species, not only due to economic considerations, but also because this has a considerable influence on the quality of the end product.

A mill having multiple milling sections, in which a cylindrical housing coaxially surrounds a rotor, is known from EP 0 226 900. The housing is sealed on one side by a welded-on base structure having integrated material and air supply means. On the diametrically opposed side, a cover connected to the housing via a flange joint and threaded bolts forms the housing closure. The rotor drive shaft is run on bearings on both sides in the area of the base structure and the cover. The rotor has grinding plates which are distributed over its circumference and interact with a stator on the inner circumference of the cylindrical housing. It is possible to disassemble this device only to a limited extent and with considerable effort. Due to the effort involved, it is not economical to retool the device for changing feedstock, which means that devices of this type are used mainly for invariable feedstock and production conditions.

Another prior-art publication is DE 23 53 907 C3, which discloses an impact mill having a housing within which is disposed a rotor in the shape of a truncated cone, which has a plurality of grinding tools oriented in an approximately radial direction. The rotor drive shaft is run on bearings on only one side in the area of the base. The housing includes a central element in the shape of a hollow truncated cone, which forms a stator on the inside and is closed on the bottom by a base and on the top by a cover. The base and cover are connected via flange joints and threaded bolts, which are not illustrated in further detail. This mill has the advantage over the one described above in that both the cover and base are removable, which however is still associated with a considerable amount of work due to the presence of the flange joints.

SUMMARY OF THE INVENTION

It is therefore an object of the invention is to further develop devices in the field of mechanical process engineering according to the definition of the species in such a way that they may be more easily disassembled and reassembled. Further objects of the invention are to optimize the flow of material within the device and to easily and thoroughly clean the device.

The invention is based on the idea of enabling the device to be easily and quickly disassembled, due to a modular structure and a special type and arrangement of clamping component. For operators of devices according to the invention, this first provides the advantage that a device according to the invention may be disassembled and reassembled in a new configuration by providing only a few different machine components. This makes it possible to adapt devices according to the invention to external conditions, such as the type and quality of the feedstock or end product as well as the type of processing, which is important in particular when variable feedstock is used. Devices according to the invention therefore have a far greater range of applications than do those according to the prior art. Due to short retooling times, the economic feasibility of a device is guaranteed, even though the device is reconfigured.

A further advantage of the devices according to the invention lies in the performance of cleaning work, which is necessary each time a product is changed for hygienic reasons in the food industry and to preserve the material purity of the end product in the chemical and pharmaceutical industries. The ability to easily and quickly disassemble a device according to the invention enables the machine components to be cleaned individually, so that areas that would otherwise be difficult to reach may be easily cleaned, and cleaning may be successful. By breaking the device down into individual machine components, these components may be cleaned by machine within a cleaning device, due to their smaller individual size.

Not least, the ability to easily and quickly disassemble a device according to the invention provides advantages in the maintenance and repair thereof. Following disassembly, all machine areas are easily accessible and damaged parts may be easily replaced.

These facilitating measures ultimately make the invention superior to known devices, not only with regard to the economical operation therefore, but in equal measure with regard to the quality of processing and consequently the quality of the resulting product.

According to a particular embodiment of the invention, the clamping component extends from one end wall of the housing to the other and clamp the casing element surrounding the rotor. In this manner, the housing of a device according to the invention may be broken down into its components solely by removing the clamping component. The clamping component may be run in corresponding bores within the housing cross section as well as be provided outside the housing cross section in the manner of clamps.

A comparable advantage is provided by another embodiment of the invention, in which clamping rings run along the outer circumference of the housing in the area of the contact joint of the individual housing components. Annular ridges on the outer circumference of the individual components, which lie together in pairs, provide an easy and quickly established connection between the individual housing components by tightening the clamping ring. The sides of the ridges interacting with the clamping ring may be conically tapered toward the outside in order to axially draw the components together when the clamping ring is tightened.

Irrespective thereof, the ability to easily disassemble a device according to the invention is expressed in an embodiment in which parts of the drive unit, namely the bearing housing and the drive shaft mounted therein, are placed in the target position merely by inserting them from the outside into a receiving opening in a housing wall. The rotor then needs only to be mounted onto the drive shaft from the other side and fixed in place. In addition to fast assembly and disassembly of the drive components, this embodiment of the invention provides the additional advantage of spatially separating the drive system from the processing system. In this manner, unencapsulated portions of the drive system do not at any time during disassembly of the device according to the invention enter the area of the processing chamber, where under certain circumstances they would be able to contaminate the feedstock. In this connection, it is also advantageous to provide the housing wall accommodating the drive unit with a thick-walled design in order to establish a rigid connection to the housing when the drive unit is inserted, providing the advantage of enabling the rotor to run true.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
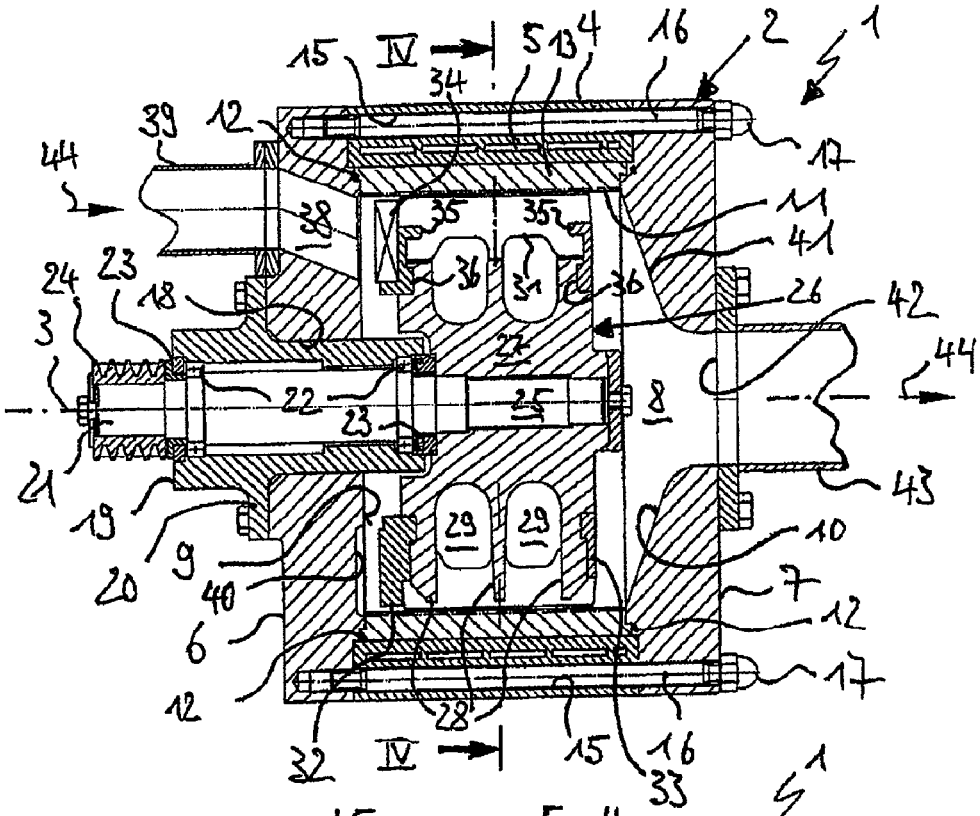
FIG. 1 shows a longitudinal cross section of a first embodiment of a device according to the invention, having a clamp integrated into the housing.
Figure 4:
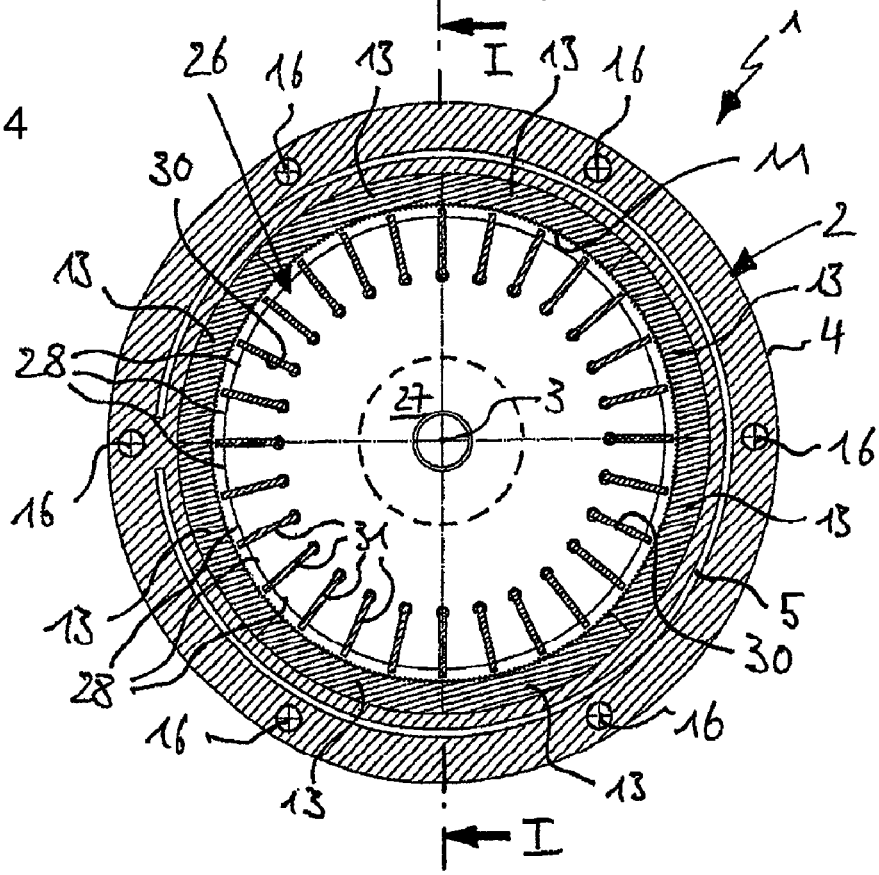
FIG. 4 shows a cross section of the device illustrated in FIG. 1 along line IV-IV.

The descriptions below explain the invention on the basis of a mill which represents the different devices in the field of mechanical process engineering. A mill 1 of this type, which is illustrated in FIGS. 1 and 4, includes a housing 2, which is formed by a casing element 4 in the shape of a hollow cylinder, i.e. closed on the circumferential side, through which pass annular circumferential cooling channel 5 in the present example. A first end wall 6 and a second end wall 7 close the end-face openings in casing element 4, forming a grinding chamber 8. To form a precisely fitting joint, a coaxial centering component is provided on inside 9 of first end wall 6 facing grinding chamber 8 and on inside 10 of second end wall 7 in the form of turned recesses 53 oriented coaxially to axis 3, which with casing element 4 engages by its circumferential edge to form a positive fit. The inside edge of casing element 4 rests against an annular shoulder which is produced by turned recess 53 and forms a radial stop. It would also be conceivable to provide an annular groove running concentrically to axis 3 on insides 9 and 10 of end walls 6 and 7, the edges of casing element 4 engaging with this groove.

A grinding path 11, whose impact surface forming the stator has an axial ribbing, is connected to casing element 4 in the radial inward direction toward grinding chamber 8. Grinding path 11 includes multiple segments 13—eight segments 13 in the present example—each of which has a curved strip section 12 on its narrow edge, by which means it is fixed precisely in position in a further turned recess 54 or an annular groove (not illustrated) on insides 9 and 10 or end walls 6 and 7 in a manner similar to casing element 4. Turned recesses 53 and 54 are positioned relative to each other in such a way that turned recesses 53 lie deeper in insides 9 and 10 than do turned recesses 54.

First end wall 6 of casing element 4 and second end wall 7 have six aligned bores 15, which run parallel to axis 3 and are distributed evenly over the housing circumference, these bores 15 being provided in first end wall 6 as fitting bores having an inner thread. Each bore 15 accommodates a tension member 16, whose threaded foot is anchored in first end wall 6 and which further penetrates casing element 4 and second end wall 7 and whose projection on the outside of second end wall 7 is clamped in place by a capped nut 17.

Housing 2 is therefore held together only by tension members 16, which clamp first end wall 6 and second end wall 7 together by clamping casing element 4 and grinding path 11. The aforementioned positive fit or centering component in the contact joint between first end wall 6 and casing element 4 or grinding path 11 as well as second end wall 7 and casing element 4 or grinding path 11 ensure a coaxial arrangement of the individual parts.

First end wall 6 has a circular opening 18 in the area of axis 3, into which a cylindrical bearing housing 19 is inserted from the outside in the axial direction to form a precise fit. Bearing housing 19 has a circumferential annular flange 20, which acts as a stop for the outside of first end wall 9 and thereby limits the depth at which bearing housing 19 is insertable into grinding chamber 8. Inserting one or more distance plates (not illustrated) makes it possible to set the insertion depth, which simultaneously allows the width of the grinding gap to be adjusted when using a housing in the shape of a hollow truncated cone and a rotor (not illustrated). Bearing housing 19 is screwed to first end wall 6 in the area of annular flange 20. The thick-walled design of first end wall 6 enables bearing housing 19 to be accommodated in a rigid manner. In the present example, the thickness of end wall 6 is at least 40 cm.

In bearing housing 19, a drive shaft 21 is rotationally mounted within bearing assemblies 22, the rotation axis of drive shaft 21 coinciding with axis 3. Seals 23 for encapsulating bearing housing 19 are provided in the area where drive shaft 21 exits bearing housing 19. The end of drive shaft 21 situated outside housing 2 supports a multiple groove pulley 24 for connection to a drive, which is not illustrated, for example an electric motor.

A rotor 26 having a cylindrical base member 27, from which radial arms 28 extend a uniform circumferential distance apart on three axially staggered vertical planes relative to axis 3, is mounted on diametrically opposed journal 25 of drive shaft 21. The three planes are separated in the axial direction by annular channels 29 which run in the radial direction in the area of radial arms 28 and are open radially to the outside to form eddy zones.

Due to the distance between radial arms 28 in the circumferential direction, slots 30 are formed which are in axial alignment with slots 30 on an adjacent plane. Grinding plates 31, which extend over the entire length of rotor 26, are inserted into slots 30, i.e. each grinding plate 31 is held over its length on the three planes between each of two radial arms 28.

Figure 6:
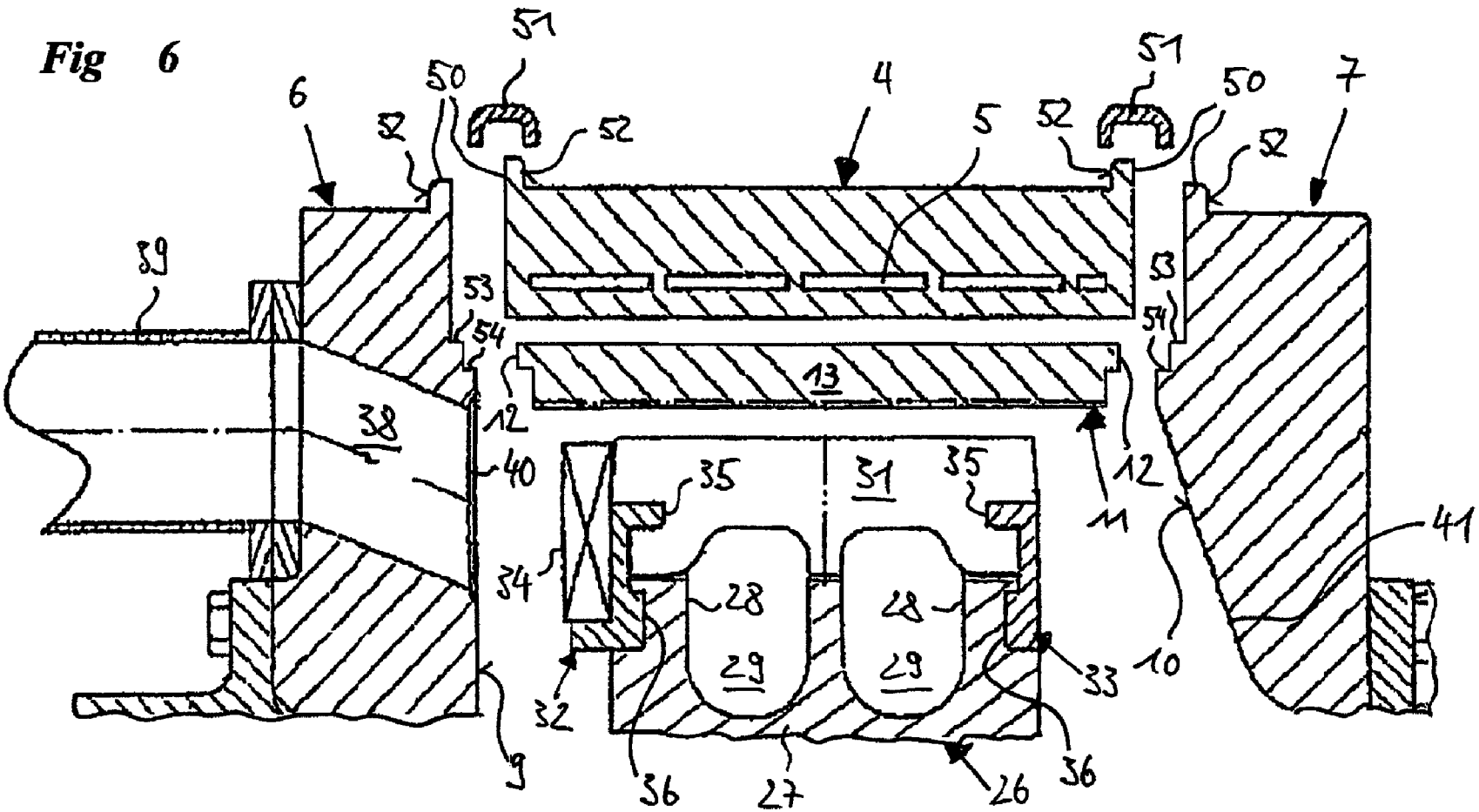
FIG. 6 shows an extended view of a partial cross section of a device according to the invention in the area of the contact joints between the casing element and end walls.

FIGS. 1 and 6, in particular, show that grinding plates 31 are fixed in place in the axial direction by establishing a positive fit with the aid of a first locking ring 32 situated concentrically to axis 3 and a second locking ring 33, which is clamped axially against the end faces of rotor 26 by screws, which are not illustrated in further detail. Locking rings 32 and 33 each have a circumferential collar 35 extending from the annular plane on their outer circumferences and a circumferential collar 36 extending to the same side from the annular plane on their inner circumferences. Collar 35 engages with complementarily shaped edge recesses in the diametrically opposed short edges of grinding plates 31 Segment 36 is in engagement with a complementarily shaped annular groove on the end faces of rotor 26. The radial force which counteracts the centrifugal force and with which grinding plates 31 are held in place is transferred in this manner solely by the positive fit. In addition, first locking ring 32 simultaneously serves as a carrier for blades 34 used to generate a carrier air stream for transporting material through mill 1.

Figure 5:
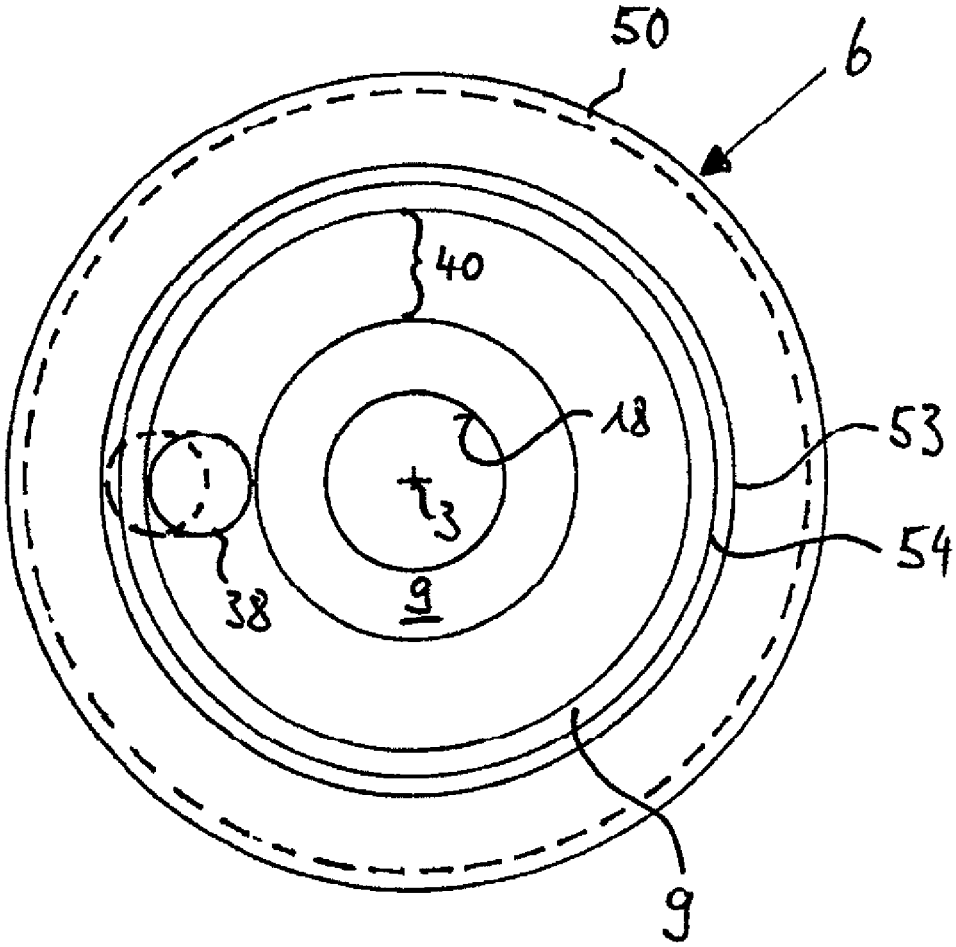
FIG. 5 shows a view of the inside of the first end wall of a device according to the invention, excluding any further machine parts.

As shown in FIGS. 1 and 5, mill 1 is loaded with feedstock via a feed channel 38 which penetrates first end wall 6 in an eccentric manner and to which a supply line 39 is connected from the outside. In grinding chamber 8, feed channel 38 empties into an annular channel 40 which is open to grinding chamber 8 and runs on inside 9 of first end wall 6. Annular channel 40 runs concentrically around axis 3 and has its greatest axial height in the area of feed channel 38 in the circumferential direction of rotor 26, this axial height decreasing linearly as it progresses and thereby transfers an axial motion component to the feedstock. The slope of the bottom of annular channel 40 may lie, for example, between 10 mm and 50 mm, preferably between 15 mm and 25 mm. Annular channel 40 as a whole is machined from the thick-walled first end face 6, which thereby represents a monolithic component. For example, the thickness of first end wall 6 is at least 25 mm. To achieve greater slopes, the thickness may also be 40 mm or more. The radial width of annular channel 40 may extend over the entire free surface of inside 9 of first end wall 6, between grinding path 11 and opening 18. However, if the width extends only over a partial area of inside 9, annular channel 40 preferably adjoins the inner circumference of grinding path 11 and therefore lies in the outer free circumferential area of inside 9.

The material is removed via a discharge hopper 41, which is integrated into second end wall 7 and whose hopper opening faces grinding chamber 8 and whose edge adjoins grinding path 11 on the side. The overall hopper surface has a continuous contour and therefore is without sharp edges. Discharge opening 42 runs concentrically to axis 3 and ends flush with the outside of second end wall 7, where a discharge line 43 is connected. The direction in which the feedstock flows through mill 1 is shown by arrows 44. Due to the coaxial arrangement of discharge hopper 41, the sufficiently finely ground feedstock must flow radially against the centrifugal force in the direction of rotation axis 3 when leaving grinding chamber 8. This produces a sifting effect that retains any feedstock that is not sufficiently finely ground in the area of grinding path 11. The separation limit may be set by suitably selecting the hopper inclination. Second end wall 7 is also provided with a thick-walled design, which enables annular channel 40 as a whole to be machined from thick-walled second end wall 7. The thickness of the second end wall depends primarily on the design of discharge hopper 41 and may be, for example, 50 mm or more.

Figure 2:
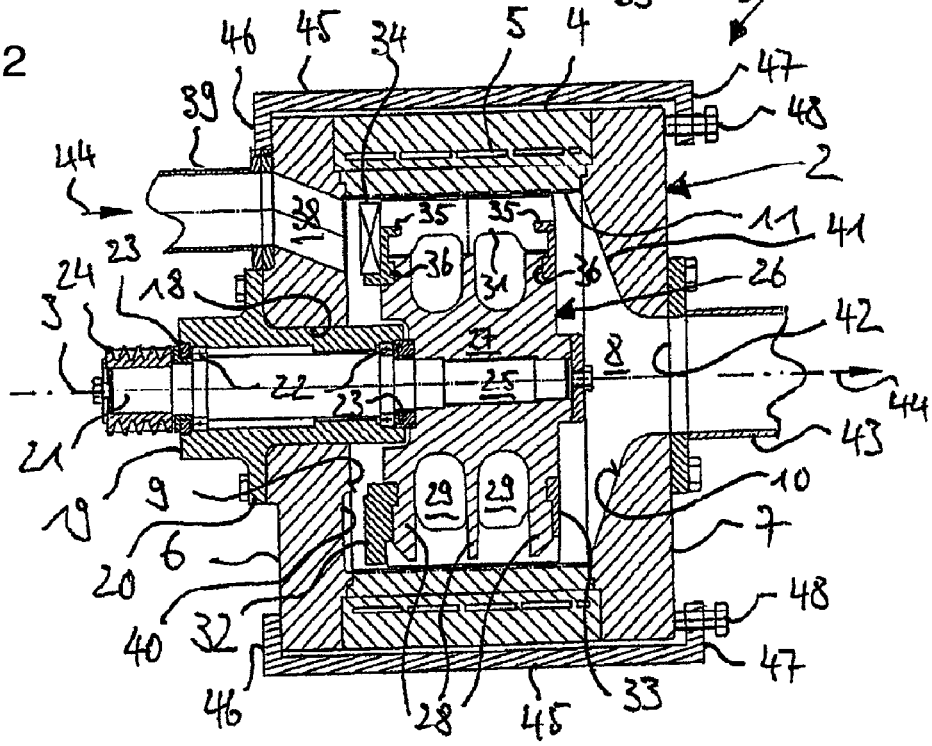
FIG. 2 shows a longitudinal cross section of a second embodiment of a device according to the invention, having externally situated clamps.

FIG. 2 shows a further embodiment of the invention, which differs from the one described above only in the type of clamping component between first end wall 6, casing element 4 and second end wall 7. For this purpose, FIG. 2 shows multiple clamping clips 45, which run parallel to axis 3 along the outer circumference of housing 2, i.e. outside housing 2. Clip 45 has a first bent end 46 which engages with first end wall 6, and a second bent end 47, which is provided with an axial threaded bore. A clamping screw 48 is screwed into the threaded bore. supported on the outside of second end wall 7 and clamps housing 2 together in the axial direction. The arrangement of multiple clips 45 makes it possible to uniformly clamp housing 2 together.

Figure 3:
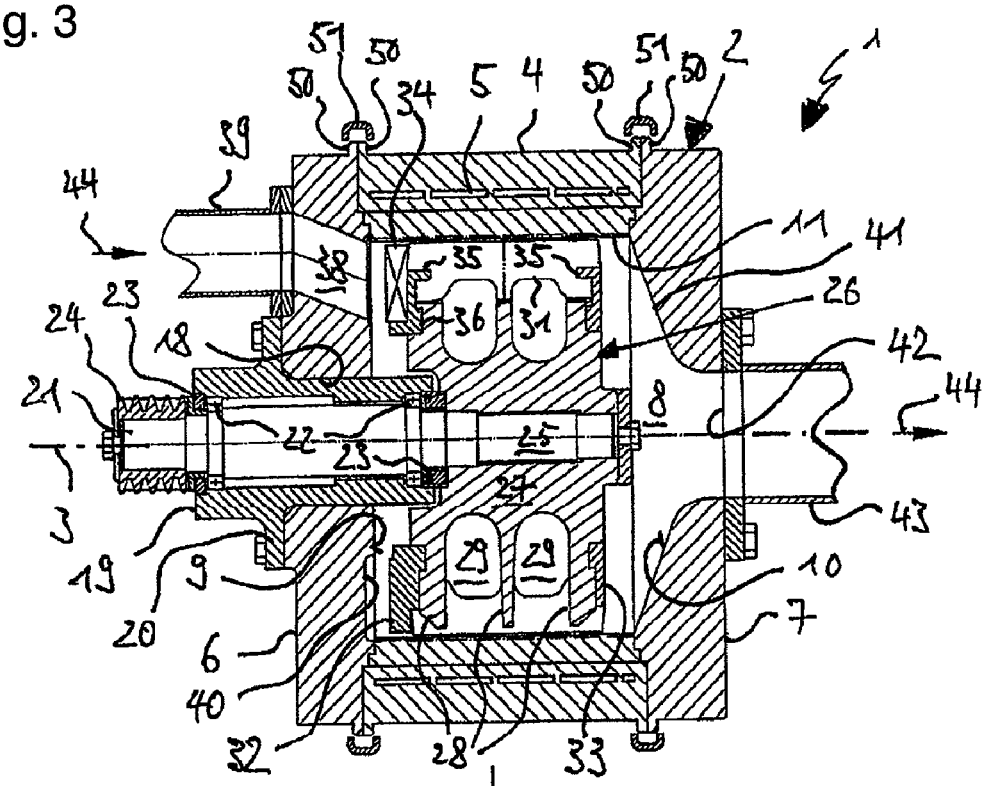
FIG. 3 shows a longitudinal cross section of a third embodiment of a device according to the invention, having a clamp in the form of clamping rings.

A third embodiment of the invention, which also permits easy and fast disassembly of the device according to the invention, is illustrated in FIG. 3. Mill 1 shown in this figure, in turn, corresponds to the one described in FIGS. 1 and 4, which differ only in the type of clamping component. In mill 1 shown in FIG. 3, first end wall 6 and casing element 4 each have a ridge 50 running around the outer circumference in their contact joints, the ridges being disposed in pairs on each side of the contact joint. Second end wall 7 and casing element 4 have a corresponding design in the area of their contact joint. By arranging a cross-sectionally U-shaped or V-shaped clamping ring 51, which accommodates ridges 50 by its two legs, first end wall 6, second end wall 7 and casing element 4 are held together in the axial direction. Due to a geometry of ridges 50, in which outer edges 52 are inclined, an active axially clamping of both ridges 50, and thus also of the two components, may be achieved (FIG. 6).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for processing feedstock, the device comprising a housing configured to surround a processing chamber, in which a rotational rotor having processing tools is mounted on a drive shaft and disposed around an axis, the feedstock being fed to the processing chamber via a material inlet and removed from the device via a material outlet, the housing comprising:

a first end wall;

a casing element in the shape of a hollow cylinder or a hollow truncated cone; and a second end wall, wherein the first end wall is configured to be clamped against the second end wall by clamping the casing element with an axially acting clamping component, and wherein the clamping component is formed by at least one tensioning member that runs within the housing cross section and whose ends are anchored in an area of the first end wall and the second end wall.

2. The device according to claim 1, wherein the second end wall has a thick-walled design, and the material outlet is machined in its entirety from the second end wall in the form of a discharge hopper.

3. The device according to claim 2, wherein the material outlet is disposed coaxially in the second end wall.

4. The device according to claim 2, wherein a diameter of the opening in the discharge hopper substantially corresponds to an inner diameter of the grinding path.

5. The device according to claim 2, wherein an inside of the discharge hopper has a continuous contour.

6. The device according to claim 1, wherein the rotor is coupled with a drive unit, which includes a bearing housing having a drive shaft rotationally mounted therein, the first end wall or the second end wall having a coaxial opening into which the bearing housing and the drive shaft are insertable from the outside in an axial direction and are fixable against the housing.

7. The device according to claim 6, further comprising a stop for limiting the insertion depth of the bearing housing.

8. The device according to claim 7, wherein the stop is adjustable in the axial direction.

9. The device according to claim 1, wherein the processing tools of the rotor interact with a grinding path that is disposed on an inner circumference of the casing element in such that a radial gap is formed relative to the processing tools of the rotor.

10. The device according to claim 9, wherein the grinding path rests loosely against the inner circumference of the casing element.

11. A device for processing feedstock, the device comprising a housing configured to surround a processing chamber, in which a rotational rotor having processing tools is mounted on a drive shaft and disposed around an axis, the feedstock being fed to the processing chamber via a material inlet and removed from the device via a material outlet, the housing comprising:

a first end wall;

a casing element in the shape of a hollow cylinder or a hollow truncated cone; and a second end wall, wherein the first end wall is configured to be clamped against the second end wall by clamping the casing element with an axially acting clamping component, and wherein the clamping component is formed by at least one clamping ring that interacts with a pair of circumferential ridges disposed in a contact joint between the casing element and the end walls.

12. The device according to claim 11, wherein a side of the ridges is inclined toward the clamping ring in the contact area.

13. A device for processing feedstock, the device comprising a housing configured to surround a processing chamber, in which a rotational rotor having processing tools is mounted on a drive shaft and disposed around an axis, the feedstock being fed to the processing chamber via a material inlet and removed from the device via a material outlet, the housing comprising:

a first end wall;

a casing element in the shape of a hollow cylinder or a hollow truncated cone; and a second end wall, wherein the first end wall is configured to be clamped against the second end wall by clamping the casing element with an axially acting clamping component, and wherein a coaxial centering component is disposed in a contact joint between the casing element and the first and/or second end wall.

14. The device according to claim 13, wherein the clamping component is formed by at least one clamping clip that runs outside the housing cross section and that is supported by an end thereof on the first end wall and the second end wall.

15. The device according to claim 13, wherein the coaxial centering component includes a turned recess or annular groove.

16. A device for processing feedstock, the device comprising a housing configured to surround a processing chamber, in which a rotational rotor having processing tools is mounted on a drive shaft and disposed around an axis, the feedstock being fed to the processing chamber via a material inlet and removed from the device via a material outlet, the housing comprising:

a first end wall;

a casing element in the shape of a hollow cylinder or a hollow truncated cone; and a second end wall, wherein the first end wall is configured to be clamped against the second end wall by clamping the casing element with an axially acting clamping component, and wherein the material inlet extends through the first end wall and empties into an annular channel that is disposed on an inside of the first end wall facing the processing chamber and that is open to the processing chamber.

17. The device according to claim 16, wherein an axial height of the annular channel decreases in a circumferential direction.

18. The device according to claim 16, wherein the first end wall has a thick-walled design, and the annular channel is machined in its entirety from the first end wall.

19. The device according to claim 16, wherein an outer diameter of the annular channel substantially corresponds to an inner diameter of the grinding path.

20. A device for processing feedstock, the device comprising a housing configured to surround a processing chamber, in which a rotational rotor having processing tools is mounted on a drive shaft and disposed around an axis, the feedstock being fed to the processing chamber via a material inlet and removed from the device via a material outlet, the housing comprising:

a first end wall;

a casing element in the shape of a hollow cylinder or a hollow truncated cone; and a second end wall, wherein the first end wall is configured to be clamped against the second end wall by clamping the casing element with an axially acting clamping component, wherein the processing tools of the rotor interact with a grinding path that is disposed on an inner circumference of the casing element in such that a radial gap is formed relative to the processing tools of the rotor, and wherein the grinding path is made of segmented grinding plates.

21. The device according to claim 20, wherein the grinding path is held in an annular groove or turned recess on an inside of the first and second end walls facing the processing chamber.

* * * * *